United States Patent [19]

Mrofchak

[11] 4,122,612

[45] Oct. 31, 1978

[54] ENERGY SAVING DEVICE UTILIZING NORMALLY WASTED HEAT FROM CLOTHES DRYERS

[76] Inventor: John J. Mrofchak, 418 Willard NE., Warren, Ohio 44483

[21] Appl. No.: 719,734

[22] Filed: Sep. 2, 1976

[51] Int. Cl.[2] ..... F26B 19/00

[52] U.S. Cl. ..... 34/86; 34/235; 137/875

[58] Field of Search ..... 34/86, 82, 235, 90; 137/610, 612

[56] References Cited

U.S. PATENT DOCUMENTS

| | | | |
|---|---|---|---|
| 2,452,898 | 11/1948 | Bourdette | 137/610 |
| 3,417,481 | 12/1968 | Rumsey, Jr. | 34/72 |
| 3,716,925 | 2/1973 | Hartung | 34/235 |
| 3,744,149 | 7/1973 | Helbling | 34/95 |
| 3,773,062 | 11/1973 | McIver | 137/610 |
| 3,871,614 | 3/1975 | Hughes | 137/610 |
| 4,011,662 | 3/1977 | Davis et al. | 34/86 |
| 4,034,482 | 7/1977 | Briscoe | 34/86 |

*Primary Examiner*—Kenneth W. Sprague
*Assistant Examiner*—James C. Yeung
*Attorney, Agent, or Firm*—Michael Williams

[57] ABSTRACT

An improved valve device adapted to be used in conjunction with a conventional clothes dryer, either gas or electric, to selectively divert into a room of a household the heated air that is normally vented to the atmosphere.

1 Claim, 4 Drawing Figures

FIG. 1.
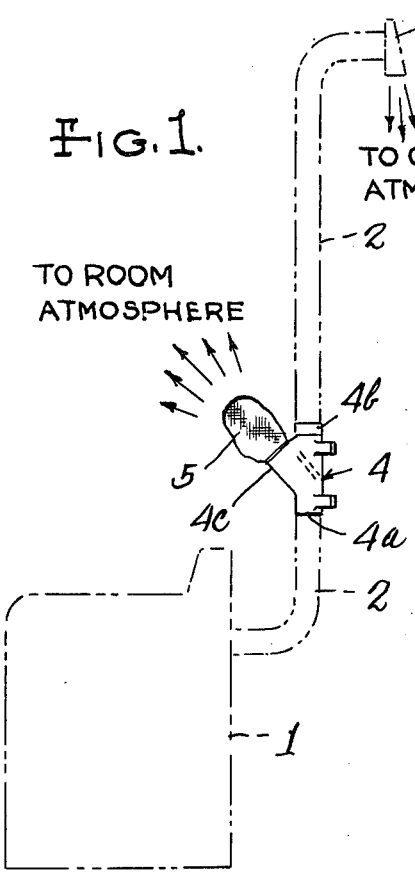
FIG. 2.
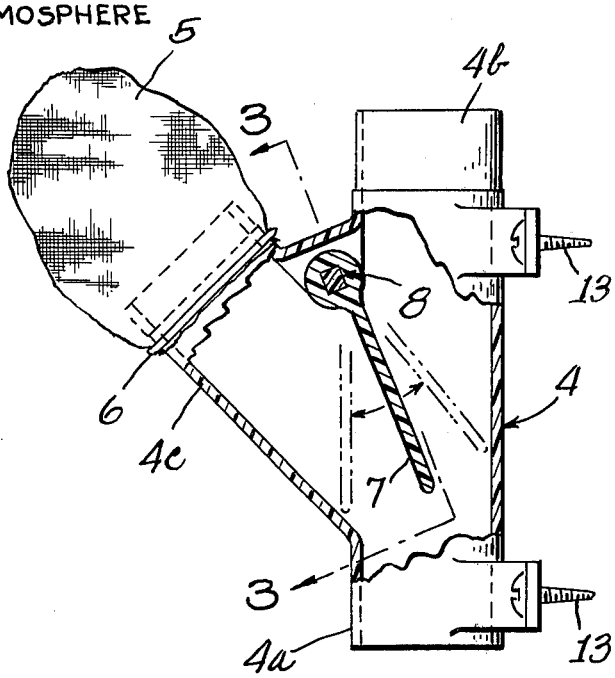
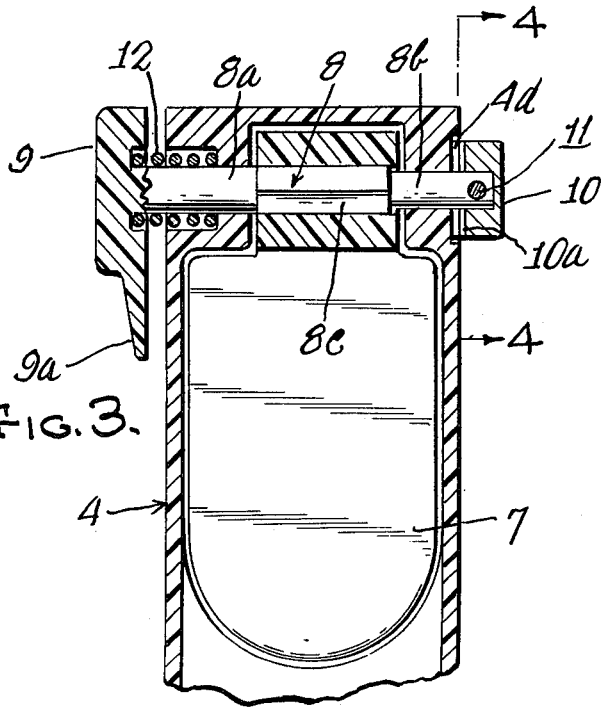
FIG. 3.
FIG. 4.
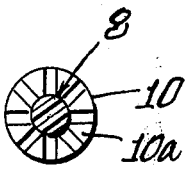

ENERGY SAVING DEVICE UTILIZING NORMALLY WASTED HEAT FROM CLOTHES DRYERS

BACKGROUND AND SUMMARY

The prior art contains patents which relate to the subject matter of this invention, and U.S. patents known to applicant are listed below: Nos.

| | | |
|---|---|---|
| 1 751 841 | Pickens | Mar 25, 1930 |
| 2 389 433 | Hough | Nov 20, 1945 |
| 2 399 555 | Locke | Apr 30, 1946 |
| 3 068 360 | Sholin | Nov 30, 1962 |
| 3 066 423 | Solem | Dec 4, 1962 |
| 3 157 391 | Angelone | Nov 17, 1964 |
| 3 197 886 | Brame et al | Aug 3, 1965 |
| 3 289 313 | Lechner Jr. et al | Dec 6, 1966 |
| 3 673 701 | Albertson | Jul 4, 1972 |

However, such prior art constructions are cumbersome and relatively complicated and because of this have apparently not found much commercial use. Some of the prior art constructions were used as auxiliary heaters in conjunction with a conventional clothes dryer but were not used during a clothes drying cycle, and therefore effected no savings in energy.

In contrast to the prior art, my improved device is simple in construction and low in manufacturing cost, and may be easily inserted into the normal duct from a conventional clothes dryer, which duct heretofore was always used to vent the warm, moist air from the dryer to the outside atmosphere.

In the winter season, the heat in most homes is very dry and homeowners frequently resorted to installation of a humidifier in the air duct of the heating system, or used portable humidifiers to supply sufficient humidity. My invention provides moist, warm air, without the need of a humidifier, and thus not only saves the cost of a humidifier but also utilizes the heated air which is normally vented to the atmosphere during a clothes-drying cycle.

My improved device comprises a relatively low-cost housing, preferably in the form of a Y fitting. One leg of the fitting is connected to the air exhaust of the clothes dryer. The second or opposite leg is connected to the normal vent to the atmosphere and the third leg directs heated air into the household room. A simple damper is disposed within the fitting to selectively direct heated air to the second or third leg, or both simultaneously, as desired.

DESCRIPTION OF THE DRAWING

In the drawing accompanying this specification and forming a part of this application, there is shown, for purpose of illustration, an embodiment which my invention may assume, and in this drawing:

FIG. 1 is a small scale side view of a preferred embodiment of my invention, with a conventional clothes dryer and conventional duct work shown in dot-dash lines, FIG. 2 is an enlarged view of the embodiment, parts being broken away to show interior construction, FIG. 3 is an enlarged, fragmentary sectional view corresponding generally to the line 3—3 of FIG. 2, and FIG. 4 is a face view of a detail corresponding generally to the line 4—4 of FIG. 3.

DESCRIPTION OF THE PREFERRED EMBODIMENT

The clothes dryer 1, shown in FIG. 1, may be any one of a number of dryers now on the market and may utilize either gas or electric as the means of producing heat for the drying of clothes placed in the dryer. A vent pipe 2 is normally connected to the dryer to vent moist, heated air to a vent cover 3 which is usually located outside the house. In the usual method of drying clothes, the wet clothes are loaded into the dryer through an access door (not shown). The dryer cycle is started and heat generated by the heating unit (not shown) disposed within the dryer is effective to drying the clothes. A high capacity fan (not shown) draws heated air through the clothes in the revolving drum in the dryer, and this air is normally blown and exhausted by the fan to the atmosphere through the vent pipe 2.

My invention comprises a housing 4 which is preferably in the form of a Y fitting molded of heat-resistant plastic, or formed aluminum, or a combination of both, and is serially inserted within the vent pipe 2, as seen in FIG. 1. One open end **4*a* of the fitting is connected to that portion of the vent pipe 2 which leads from the dryer. The opposite or second open end 4*b* of the fitting is connected to part of the vent pipe 2 which leads to the vent cover 3. The third open end 4*c*** of the fitting is adapted to communicate with the interior of a room in which the dryer is located, or by suitable duct work, to another room, or several rooms.

The conventional clothes dryer normally has a built-in air filter to remove lint and the like from the air vented from the dryer. However, to insure complete lint removal, I prefer to install an additional air filter in connection with the fitting leg **4*c*. If the leg 4*c* vents directly into a room, a removable bag-like filter 5 may be clamped around the opening of a leg 4*c* by means of an elastic band or endless coil spring 6, as seen in FIG. 2**. This bag-like filter may be removed for cleaning as required.

Located within the fitting 4 is a damper 7 which may be swung to various positions, as shown in full and dot-dash lines in FIG. 2, to either close off air flow to the fitting leg **4*c*, or to leg 4*b*, or provide for divided air flow to both legs. The damper 7 is carried by a shaft 8 which has round portions 8*a* and 8*b* journalled in bosses provided within the fitting 4. An intermediate non-circular shaft portion 8*c* (preferably square in cross-section) engages in a complementary opening in the damper so that the latter is constrained to rotative movements of the shaft 8**.

A manually operable knob 9 is integral with the shaft 8. Built into the knob 9 is a pointer **9*a*, which is in line with the damper 7, to indicate the damper position. A collar 10 is connected to an outwardly extending end of the shaft 8, preferably be means of a pin 11. On an inner face, the collar 10 has serrations 10*a* which co-operate with serrations 4*d* formed on the fitting 4**, or on a washer (not shown) secured to the fitting.

A coil spring 12 is interposed between the knob 9 and an adjacent outer surface of the fitting 4 to normally urge the shaft 8 to the left, as viewed in FIG. 3, so as to hold the serrations **4*d* and 10*a* in interengaging relation and thus prevent rotation of the shaft 8. A slight push on the knob 9 will move the shaft 8 to the right and disengage the serrations 4*d* and 10*a* and thus permit rotation of the shaft 8, and connected damper 7, by manual rotation of the knob 9**.

The vent pipe 2 may be either a rigid sheet aluminum pipe, or a flexible conduit and, in case of the latter, it is preferable to firmly connect the fitting 4 to a wall through use of fasteners such as the screws 13, which pass through ears formed on the fitting.

During warm weather, when no additional heat or moisture is required in a room, the damper is moved to a position in which it fully closes air flow to the fitting leg 4*c*. In this position all air is vented to the outside atmosphere. In cold weather, the damper 7 may be moved to a position to provide for full or partial air flow to the fitting leg 4*c*.

I claim:

1. For use with a conventional clothes dryer having a heat source and a high capacity fan for driving heated air through the clothes to be dried, and a vent pipe for venting heated, moist air from said dryer to the atmosphere, the improvement comprising:

a hollow fitting comprising three tubular intercommunicating portions, a first tubular portion being adapted for connection to a first vent pipe part leading from the dryer, and a second tubular portion being adapted to be connected to a second vent pipe part leading to the atmosphere, the open end of a third tubular portion being adapted to communicate with space in the building in which said dryer is located, a damper disposed within said fitting and movable from one position to another, in said one position blocking air flow from said first tubular portion through said second tubular portion while permitting such air flow to exhaust through said third tubular portion and to said building space, and in said other damper position blocking air flow from said first tubular portion through said third tubular portion while permitting such air flow to exhaust through said second tubular portion and to the atmosphere, said damper being fixed to a shaft, the opposite ends of the latter being journalled within openings in said fitting and extdnding outwardly of said fitting, one shaft end having a manually manipulatable knob fixed there to and the other shaft end having a disc secured thereto, a face of said disc facing an exterior surface of said fitting and said face and surface having interengagable abutments for holding said damper in any one of a number of adjusted positions, a compression spring surrounding said shaft one end and disposed between said knob and an exterior surface of said fitting, said spring being operable to releasably hold said abutments in engagement, and a bag-like filter having an inlet mouth portion disposed closely over the open end of said third tubular portion and detachably secured thereto, said filter preventing lint and the like from said clothes dryer from entering said building space.

* * * * *